United States Patent [19]

Booth

[11] 4,330,896

[45] May 25, 1982

[54] TOOTHBRUSHES

[76] Inventor: Peter A. Booth, Furtherfield, Chenies Rd., Chorleywood, Hertfordshire, England

[21] Appl. No.: 172,432

[22] Filed: Jul. 25, 1980

[30] Foreign Application Priority Data

Jul. 25, 1979 [GB] United Kingdom ..... 7925979

[51] Int. Cl.[3] ..... A46B 9/04; A46B 9/08

[52] U.S. Cl. ..... 15/172; 15/167 R; 15/176

[58] Field of Search ..... 15/172, 176, 144 R; 403/97, 159

[56] References Cited

U.S. PATENT DOCUMENTS

| | | | |
|---|---|---|---|
| 1,968,303 | 7/1934 | McMath | 15/167 R |
| 2,053,905 | 9/1936 | Fuller | 15/167 R |
| 2,091,716 | 8/1937 | Petta | 15/172 |
| 2,154,352 | 4/1939 | Peterson | 15/167 R |

FOREIGN PATENT DOCUMENTS

| | | | |
|---|---|---|---|
| 279994 | 2/1914 | Fed. Rep. of Germany | 15/144 R |
| 899033 | 12/1953 | Fed. Rep. of Germany | 15/172 |
| 1025666 | 1/1953 | France | 403/97 |
| 1312471 | 11/1962 | France | 15/144 R |

*Primary Examiner*—Peter Feldman

*Attorney, Agent, or Firm*—Brisebois & Kruger

[57] ABSTRACT

This invention relates to toothbrushes of the kind in which a head having bristles projecting from at least one side thereof is articulated to an adjacent end of a handle for adjustment of the head with respect to the handle.

The articulating means of the invention include a pair of projections integral with either the head or the handle and journalled in cooperating sockets in the other part, and means are provided for resisting relative turning movement between the head and handle, whereby the head and handle are adapted to be set in a desired position relatively to one another without being locked in said position.

10 Claims, 8 Drawing Figures

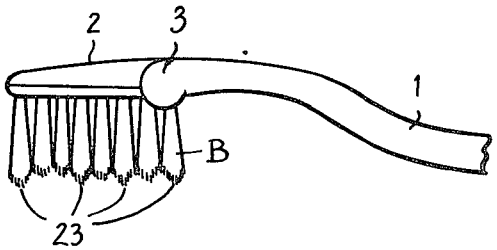
Fig.5
Fig.6
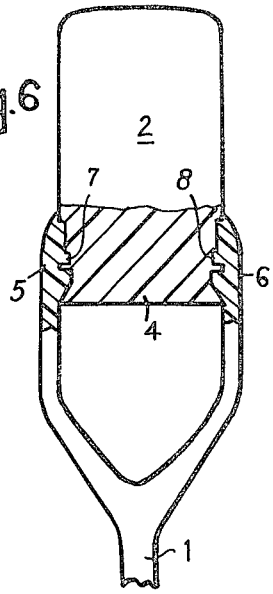
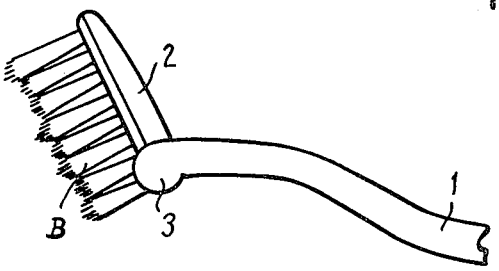
Fig.7
Fig.8
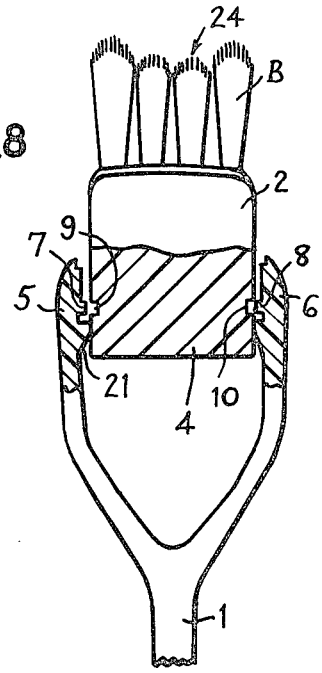

TOOTHBRUSHES

BACKGROUND OF THE INVENTION

The present invention relates to toothbrushes and, more particularly, to toothbrushes in which the head carrying the bristles is adjustable relatively to the handle to facilitate brushing and cleaning of the teeth, the spaces between the teeth and the gums.

The problems attendant upon the proper care and cleaning of the teeth are well known. The recommended actions for cleaning teeth are either brushing downwardly from the gums or, preferably, wriggling the brush with the ends of the bristles in contact with the teeth which is more effective method of removing food debris accumulated in the spaces between the teeth. Conventional toothbrushes are quite effective for brushing and cleaning the front surfaces of the teeth and gums and the front inter-tooth spaces by either of these recommended methods. However, difficulties arise when either method is applied to brushing the rear surfaces of the teeth and gums. Moreover, it is important that excessive brushing pressure is avoided when cleaning the teeth as, over an extended period, this is likely to wear the teeth and damage the gums.

Many different constructions of toothbrush have been proposed for facilitating thorough brushing and cleaning of all surfaces of the teeth and gums. One such construction described in U.S. Pat. No. 1,369,664 comprises a handle so arranged that a finger may be inserted into the handle to permit manipulation of the toothbrush, and a brush head which is articulated midway along its length and is connected to the handle by another hinged joint. All the joints are constructed so that there is sufficient friction to maintain the toothbrush, while in use, in the shape in which it is bent. U.S. Pat. No. 4,020,521 describes another arrangement in which the brush head is pivoted to the handle for rotation about an axis generally parallel to the bristles. Yet another construction is described in Austrian Pat. No. 279994 in which the toothbrush is formed in two parts articulated together approximately mid-way between opposite ends of the brush with adjustment about an axis perpendicular to the axis of the handle so that the brush proper can be cranked relative to the handle. The two parts are locked in a desired cranked position by an array of inter-engaging ribs and grooves and a locking screw.

In the prior constructions, the articulated connections are generally complicated, and in practice, do not provide for satisfactory brushing and cleaning of the rear surface of the teeth and gums, and/or do not provide for brushing and cleaning under a controlled pressure to alleviate wear of the teeth and damage to the gums. Hence, there is a need for a simple and inexpensive toothbrush having an adjustable head which will permit effective brushing and cleaning of all surfaces of the teeth and gums under a controlled pressure.

SUMMARY OF THE INVENTION

It is an object of the present invention to provide a toothbrush having an articulated head which is adjustable in a plane containing the axis of the handle and parallel to the bristles of the brush to permit effective brushing and cleaning of all surfaces of the teeth and gums and the spaces between the teeth. Another object is to provide such a toothbrush in which the head is settable in a desired cranked position relative to the handle and is retainable in this position without the use of locking screws, nuts or pins or other separate locking devices but which permits the head to move away from the teeth under excessive brushing pressure whereby to control the brushing pressure applied to the teeth when using the toothbrush. A further object is to provide a toothbrush having an articulated head which is readily adjustable to a required cranked position for properly brushing and cleaning the teeth and gums and which is adjustable whilst in use and gripped in one hand without the need for the user to employ his other hand to manipulate the head.

The present invention provides a toothbrush in which the head part of the brush having bristles projecting from at least one side thereof is articulated to the adjacent end of the handle part so as to be adjustable about a pivot axis which extend transversely to a plane containing the axis of the handle and substantially perpendicularly to the bristles into a cranked position in which the bristles generally face towards the handle part. The articulated joint includes a pair of projections integral with one of the parts journalled in cooperating sockets in the other part and cooperating means is provided between the two parts for resisting relative turning movement of the parts, whereby the head and handle are settable in a desired position relatively to one another but without being locked in said position.

With this construction according to the invention the head is readily adjustable to a required position whilst in use and being gripped by one hand by gripping or manipulating the head with the mouth.

It will be seen that the head can be set in any desired cranked position with respect to the handle between the position in which the head is aligned with the handle and a position in which the head is substantially perpendicular to the axis of the handle. For example, when it is desired to clean the rear surfaces of the front teeth, the head is turned to a position in which it is approximately perpendicular to the axis of the handle so that with the handle inserted into the mouth and between the teeth the free ends of the bristles naturally contact the rear surfaces of the teeth and gums and can be easily wriggled in contact therewith to clean these surfaces. In the event of the application of an excessive cleaning pressure, which is determined by the means resisting relative turning movement between the head and handle parts, the head turns about its pivot axis and thus prevents the use of excessive cleaning pressure.

In a preferred embodiment, the end of the handle part adjacent the head is bifurcated and the head part includes a portion projecting between the bifurcated end of the handle and is articulated to the handle at this position. The projections forming the articulation may comprise a pair of trunions, pins or bosses on either part journalled in a complementary socket on the other part. However, in the preferred embodiment, the projections are disposed at the bifurcated end of the handle part and engage in sockets on the portion of the head disposed between the bifurcated end of the handle.

The means for resisting turning movement between the head and handle parts may comprise at least one rib on one of the parts extending radially with respect to the pivot axis and engaging in at least one fan-or sector-shaped array of cooperating grooves arranged coaxially with the pivot axis on the other part. The complementary ribs and grooves are preferably of saw-toothed shape in cross-section and may include a shallow flank and a steeper flank intercepting at the apex of the or each rib or groove, whereby to provide greater resistance to turning of the head relatively to the handle from a cranked position into the position in which it is in alignment with the handle.

Conveniently, means are provided on the head and handle parts which cooperate together to withdraw the projections from their associated sockets in response to turning of the head part into a position in which its bristles generally face away from the handle part, whereby to permit the head to be disconnected and removed from the handle. Such a construction provides for ready assembly or interchange of the head.

Preferably, the surface defined by the free ends of the bristles is profiled to facilitate cleaning of individual teeth and the spaces therebetween. Hence, in side elevation, this surface may have a scalloped appearance, for example, having three scalloped portions of different sizes corresponding to the surface size of different teeth. As viewed in end elevation, the surface may have a concave configuration. Tufts of bristles spaced along opposite sides of the head and defining the apices between the scallops may be harder than the other tufts of bristles and these harder tufts are so positioned that they may project into the spaces between the teeth on opposite sides of the contact area between the teeth for cleaning the spaces and will also massage the gums whilst the remaining softer areas of bristles are disposed in positions for cleaning the surfaces of the teeth and avoid undue wear of these surfaces.

BRIEF DESCRIPTION OF THE DRAWINGS

In order that the invention may be more readily understood, reference will now be made to the accompanying drawings which show one embodiment thereof by way of example and in which:

FIGS. 7 and 8 are respectively fragmentary side and plan views, the latter being partially in section, illustrating further details.

DETAILED DESCRIPTION OF PREFERRED EMBODIMENT

Figure 1:
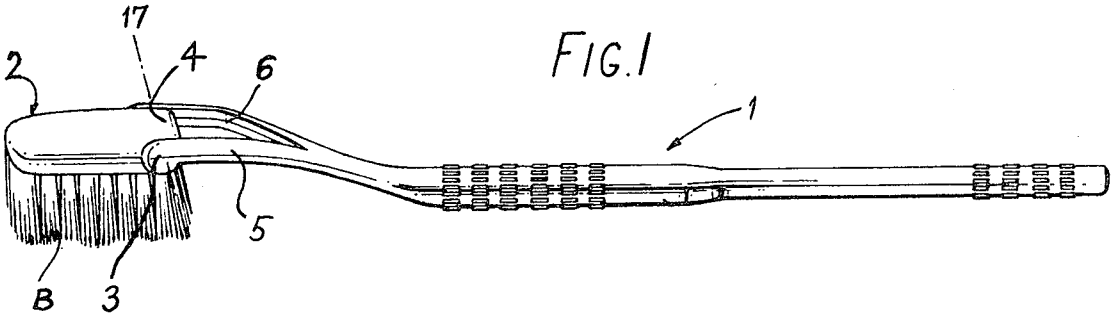
FIG. 1 is a perspective view of a toothbrush embodying the invention.
Figure 2:
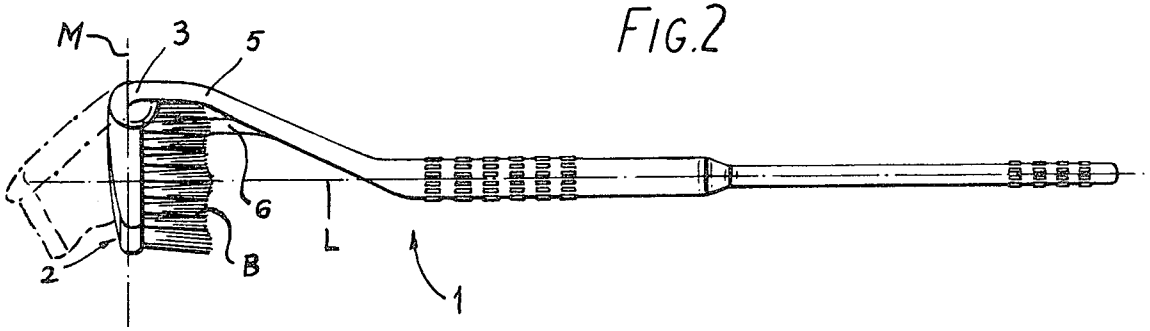
FIG. 2 is a side elevation of the toothbrush illustrating cranked positions of the head.

Referring to FIGS. 1 and 2 of the drawings, the brush comprises an elongated handle 1 having a head 2 provided with bristles B projecting from the lower side or face thereof. The head is articulated to the adjacent end of the handle by means of a hinge joint generally indicated at 3. To this end, the adjacent end of the handle is bifurcated and the head part includes a portion 4 projecting between the two arms 5, 6 of the bifurcation and articulated to these arms by means of a pair of trunions 7,8 projecting inwardly from the arms adjacent the ends thereof and journalled in cooperating sockets 9,10 formed in opposing surfaces of the portion of the head 4 projecting between the arms. In order to control adjustment of the head relative to the handle and enable it to be set or latched in the required cranked position, radially extending ribs 11,12 are formed respectively adjacent the trunions which engage in a fan-shaped array 13 of complementary grooves formed in the opposing surface portion of the head. Each fan-shaped array of grooves extends radially outwardly from its adjacent socket and the array is coaxial with the latter. The ribs 11, 12 and grooves 14, are of saw-toothed shape in cross-section and include a shallow flank 15 and a steeper flank 16 intersecting the apex or base of the rib and grooves. The arrangement of the flanks is such that the head 2 can be readily adjusted relatively to the handle 1 in an anti-clockwise direction, as viewed in FIGS. 1–4, whilst in the opposite direction, the steeper flanks 16 engage to provide a greater resistance to turning movement. As will be seen from FIG. 2, a portion of the handle part is offset with respect to the longitudinal axis L of the handle part so that the longitudinal axes of the two parts, in normal orientation, intersect towards the free end of the head, the axis of the part being shown at M. Thus the longitudinal axis L of the handle 1 is in alignment with the direction of the bristles B.

On the opposite side of the pivot axis 17 to the rib 12 and cooperating array 13 of grooves 14, the bearing surface portions of the head and arms shown at 25 and 26 respectively, are formed with means which cooperate in response to turning of the head part into a position in which the bristles B generally face away from the handle part, as shown in FIGS. 7 and 8, to withdraw the trunions from their associated sockets. This means comprises radially extending rib-like bosses 18, 19 on the bearing surfaces of the arms 5, 6, respectively engaging in arcuate grooves 20, formed in the bearing surfaces of the head 2. The end of the groove 20 which is disposed adjacent the boss when the head and handle are aligned is inclined or bevelled to provide a ramp 21 leading into the bearing surface portion of the head so that upon turning of the head in a clockwise direction into a position as illustrated in FIG. 7, in which the bristles generally face away from the handle part, the boss 18(19) rides up its associated ramp on to the bearing surface of the head 2 and thereby flexes the bifurcated arms 5, 6, of the handle apart so as to withdraw the trunions 7, 8 from their associated sockets, whereupon the head 2 can be disconnected from the handle part 1 and, if desired, can be exchanged for a fresh head. This is achieved by the reverse process, each boss 18(19) being formed with an inclined face 22 on its radially outer end so as to permit the arms 5, 6 to be flexed apart as the head 2 is introduced between them.

Conveniently, the head part 2 and the handle part 1 are each formed as one-piece mouldings of resilient plastics material.

The free ends of the bristles B, which may be made from a natural or synthetic material, define a surface which has a generally scalloped configuration 23 in side elevation and a concave configuration 24 in end elevation as is more clearly shown in FIGS. 5, 7 and 8. In side elevation, there are three scallops which may vary in width.

Such an arrangement facilitates cleaning of different size teeth in the mouth. Moreover, the types of bristles which define the apices of the scalloped configuration 23 are harder than the remaining tufts of bristles so that these can project into the spaces between the teeth for cleaning the spaces and can massage the gums. The central softer bristles engage and clean the surfaces of the teeth and avoid undue wear of these surfaces.

Figure 3:
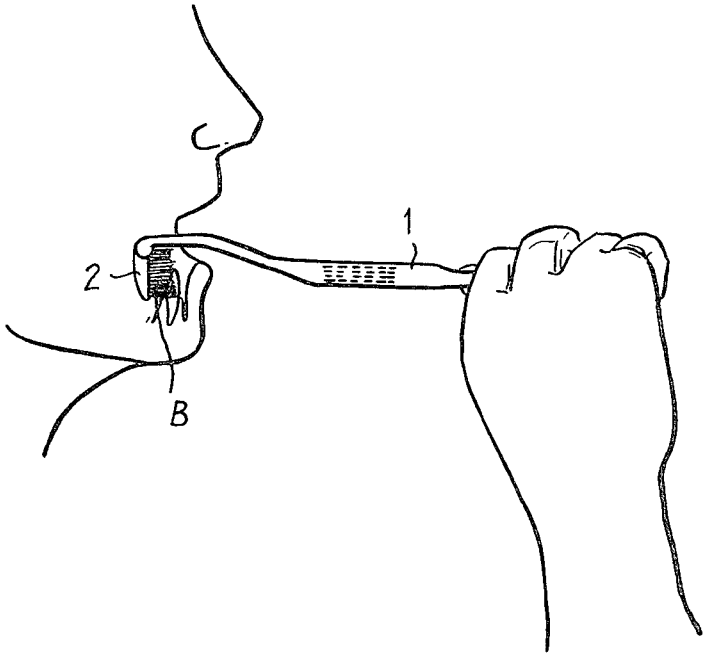
FIG. 3 illustrates the use of the toothbrush to clean the backs of the teeth.
Figure 4:
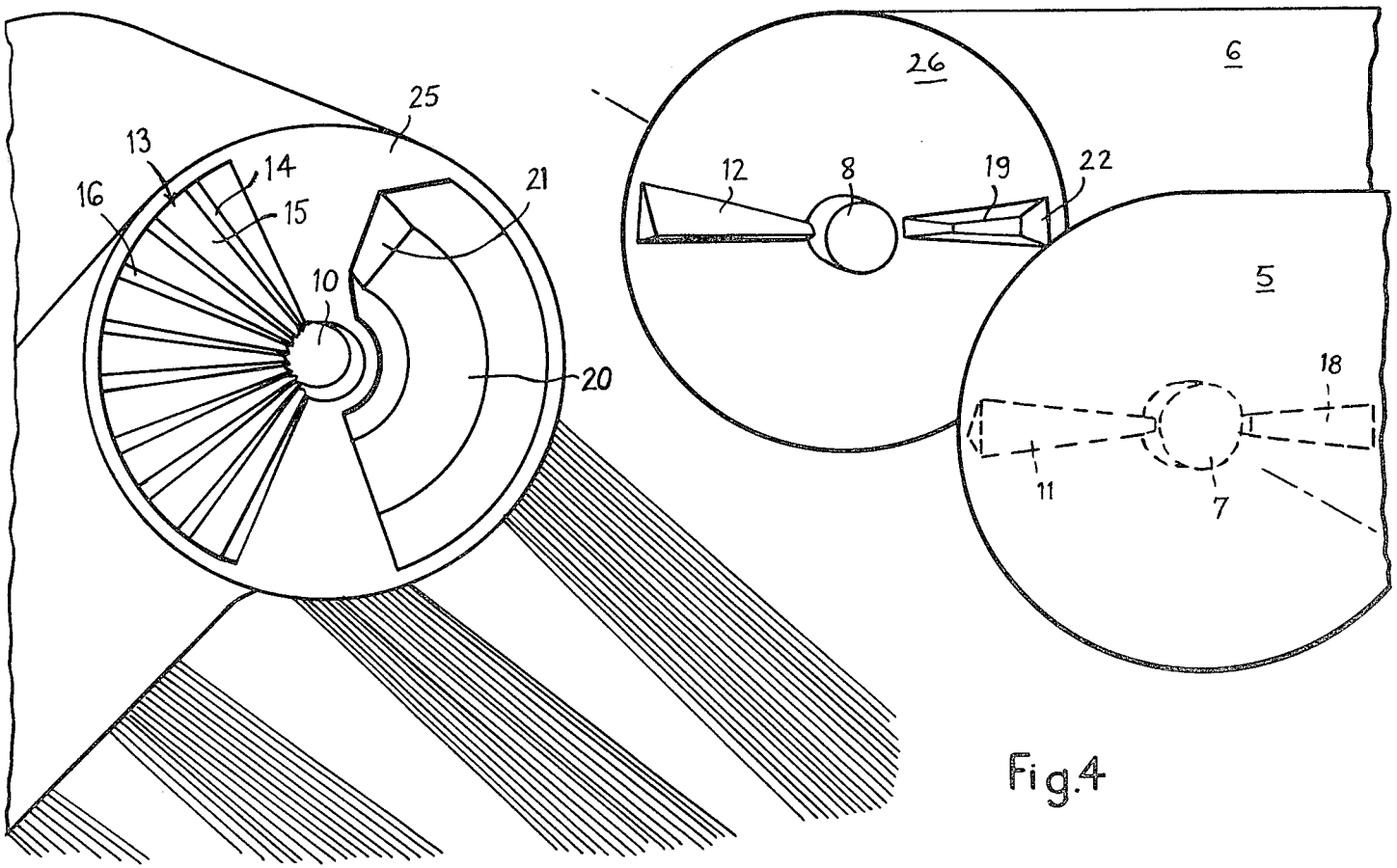
FIG. 4 is a fragmentary perspective view illustrating details of the articulated connection between the head and the handle, FIGS. 5 and 6 respectively illustrate a fragmentary side elevation and plan view, the latter being partially in section, illustrating details of the shape of the bristles and the articulated connection.

FIG. 3 shows how the toothbrush is used to clean the backs of the teeth; the head 2 is pivoted into the position shown in FIG. 2 and the brush is introduced into the mouth so that the head 2 and bristles B lie behind the teeth perpendicular to the handle 1. This enables the brush to be effectively wriggled with the ends of the bristles in contact with the teeth which I believe is the correct and most effective method of removing food debris accumulated in the spaces between the teeth.

I claim:

1. In a toothbrush comprising an elongated handle part, a head part having bristles projecting from at least one side of said head part, and articulating means connecting said head part to an adjacent end of said handle part for adjustment of said head part about a pivot axis which extends transversely to a plane containing the axis of the handle part and substantially perpendicularly to the bristles into a selected one of a multiplicity of cranked positions in which said bristles generally face towards said handle part, the improvement which facilitates adjustment of said head part into a selected cranked position whilst permitting control of brushing pressure and which is characterised in that said articulating means includes (i) a pair of projections integral with one of said parts and journalled in cooperating sockets in the other said part, and (ii) resisting means located between said head and handle parts for resisting relative turning movement thereof (iii) said resisting means being adapted to retain said head part set in a selected cranked position without being locked in said position, and (iv) said resisting means being adapted to permit said head part to turn from said selected cranked position in response to an excessive brushing pressure, as predetermined by said resisting means, to relieve said brushing pressure.

2. A toothbrush according to claim 1, wherein said adjacent end of said handle part is bifurcated and said head part includes a portion projecting between said bifurcated end, said articulating means being arranged between said bifurcated end of said handle part and said projecting portion of said head part.

3. A toothbrush according to claim 1 or 2, wherein said projections are disposed on said handle part and said sockets are disposed in said head part.

4. A toothbrush according to claim 1, wherein said resisting means for resisting turning movement between said head and handle parts includes at least one fan-shaped array of grooves on one of said parts operatively engaged by at least one cooperating radial rib on the other said part.

5. A toothbrush according to claim 4, comprising a fan-shaped array of said grooves associated and substantially coaxial with each said socket of said articulating means and a cooperating rib associated with and disposed substantially radially with respect to each said projection.

6. A toothbrush according to claim 4, wherein said at least one radial rib includes a shallow flank and a steeper flank intersecting at the apex of said rib, and said grooves of said cooperating array have complementary shapes whereby to provide greater resistance to turning of said head from a cranked position towards alignment with said handle part.

7. A toothbrush according to claim 1, including means on said head and handle parts operatively associated to withdraw said projections from said sockets in response to turning of said head part into a position in which said bristles generally project away from said handle part, whereby to permit disconnection of said head and handle parts.

8. A toothbrush comprising (a) an elongated handle part (b) a head part having bristles projecting from at least one side of said head part, (c) articulating means connecting said head part to an adjacent end of said handle part for adjustment of said head part about a pivot axis extending transversely to the plane which contains the axis of said handle part and is disposed substantially parallel to said bristles into a cranked position in which said bristles generally face toward said handle part, (d) said articulating means including (i) a pair of projections integral with one of said parts and journalled in cooperating sockets in the other said part, and (ii) resisting means for resisting relative turning movement between said head and handle parts, said resisting means being adapted to retain said parts set in a selected cranked position without being locked in said position, (e) withdrawing means on said head and handle parts operatively associated to withdraw said projections from said sockets in response to turning of said head part into a position in which said bristles generally project away from said handle part, whereby to permit disconnection of said head and handle parts, (f) said withdrawing means including (i) a boss disposed on one of said parts adjacent each said projection and socket, and (ii) a cooperating arcuate recess disposed on the other said part and provided with a bevelled end, (iii) said bosses being engageable in said cooperating arcuate recesses when said projections and sockets are engaged and being engageable with said bevelled ends of said recesses in response to turning of said head part for withdrawing said projections from said sockets.

9. A toothbrush according to claim 1, wherein the surface defined by the projecting ends of the bristles is profiled to facilitate cleaning of the teeth and adjacent spaces.

10. A toothbrush according to claim 1, wherein a portion of said handle part adjacent said head part is offset with respect to the longitudinal axis of said handle part so that the longitudinal axes of the two parts, in normal orientation, intersect towards the free end of said head part.

* * * * *